US010906690B2

(12) United States Patent
Holley, Jr.

(10) Patent No.: US 10,906,690 B2
(45) Date of Patent: Feb. 2, 2021

(54) METHOD OF FORMING A CARTON WITH ARTICLE PROTECTION FEATURE

(71) Applicant: Graphic Packaging International, LLC, Atlanta, GA (US)

(72) Inventor: John Murdick Holley, Jr., Lawrenceville, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 210 days.

(21) Appl. No.: 16/264,876

(22) Filed: Feb. 1, 2019

(65) Prior Publication Data

US 2019/0161234 A1 May 30, 2019

Related U.S. Application Data

(62) Division of application No. 13/833,542, filed on Mar. 15, 2013, now Pat. No. 10,232,974.
(Continued)

(51) Int. Cl.
*B65B 11/00* (2006.01)
*B65B 5/02* (2006.01)
(Continued)

(52) U.S. Cl.
CPC ..... *B65D 5/4608* (2013.01); *B65B 5/024* (2013.01); *B65B 11/004* (2013.01);
(Continued)

(58) Field of Classification Search
CPC ..... B65B 5/024; B65B 11/004; B65B 21/242; B65D 5/02; B65D 5/0227; B65D 5/443;
(Continued)

(56) References Cited

U.S. PATENT DOCUMENTS 1,653,116 A 12/1927 Parks
2,196,502 A 4/1940 Kells
(Continued)

FOREIGN PATENT DOCUMENTS

EP 0024782 3/1981
EP 0870688 A1 10/1998
(Continued)

OTHER PUBLICATIONS

International Search Report and Written Opinion for PCT/US2013/031896 dated Jun. 21, 2013.
(Continued)

*Primary Examiner* — Stephen F. Gerrity
(74) *Attorney, Agent, or Firm* — Womble Bond Dickinson (US) LLP

(57) ABSTRACT

A carton for holding a plurality of articles. The carton comprises a plurality of panels that extends at least partially around an interior of the carton and a plurality of end flaps respectively foldably connected to respective panels of the plurality of panels. The plurality of end flaps are at least partially overlapped with respect to one another to thereby at least partially form a closed end of the carton. The carton also can comprise at least one article protection flap foldably connected to at least one end flap of the plurality of end flaps for engaging at least one article of the plurality of articles. The at least one article protection flap extends from the closed end at least partially into the interior of the carton.

19 Claims, 7 Drawing Sheets

Related U.S. Application Data

(60) Provisional application No. 61/741,315, filed on Jul. 17, 2012, provisional application No. 61/741,314, filed on Jul. 17, 2012, provisional application No. 61/797,758, filed on Dec. 14, 2012.

(51) Int. Cl.

| | |
|---|---|
| ***B65B 21/24*** | (2006.01) |
| ***B65D 5/468*** | (2006.01) |
| ***B65D 5/44*** | (2006.01) |
| ***B65D 71/36*** | (2006.01) |
| ***B65D 5/18*** | (2006.01) |
| ***B65D 5/42*** | (2006.01) |
| ***B65D 71/18*** | (2006.01) |

(52) U.S. Cl.

CPC ..... *B65B 21/242* (2013.01); *B65D 5/18* (2013.01); *B65D 5/42* (2013.01); *B65D 5/445* (2013.01); *B65D 71/18* (2013.01); *B65D 71/36* (2013.01); *B65D 2571/0045* (2013.01); *B65D 2571/0066* (2013.01); *B65D 2571/00141* (2013.01); *B65D 2571/00265* (2013.01); *B65D 2571/00302* (2013.01); *B65D 2571/00308* (2013.01); *B65D 2571/00524* (2013.01); *B65D 2571/00561* (2013.01); *B65D 2571/00728* (2013.01)

(58) Field of Classification Search

CPC ..... B65D 5/4608; B65D 71/18; B65D 71/36; B65D 2571/00253; B65D 2571/00259; B65D 2571/00271; B65D 2571/00308; B65D 2571/00524; B65D 2571/00839

USPC ..... 53/456; 206/427

See application file for complete search history.

(56) References Cited

U.S. PATENT DOCUMENTS

| | | | | |
|---|---|---|---|---|
| 2,308,050 | A | 1/1943 | Burr | |
| 2,386,905 | A | 10/1945 | Meitzen | |
| 2,648,484 | A | 8/1953 | Belsinger | |
| 2,850,159 | A * | 9/1958 | McGihon | B65D 71/32 206/427 |
| 2,900,123 | A | 8/1959 | Drnec et al. | |
| 3,152,688 | A | 10/1964 | Mahon | |
| 3,173,596 | A | 3/1965 | Aust et al. | |
| 3,294,270 | A | 12/1966 | Geisler | |
| 3,756,499 | A | 9/1973 | Giebel et al. | |
| 3,788,538 | A | 1/1974 | Kuenzi | |
| 3,904,036 | A * | 9/1975 | Forrer | B65D 71/36 206/427 |
| 3,933,300 | A | 1/1976 | Dempster | |
| 3,979,882 | A | 9/1976 | Howe | |
| 4,005,815 | A | 2/1977 | Nerenberg et al. | |
| 4,012,887 | A | 3/1977 | Calvert et al. | |
| 4,056,223 | A | 11/1977 | Williams | |
| 4,095,693 | A | 6/1978 | Killy | |
| 4,131,230 | A | 12/1978 | Koehlinger et al. | |
| 4,146,168 | A | 3/1979 | Hartline | |
| 4,328,891 | A * | 5/1982 | Elward | B65D 71/36 206/147 |
| 4,437,569 | A | 3/1984 | Sorenson | |
| 4,438,843 | A | 3/1984 | Graser | |
| 4,538,759 | A | 9/1985 | Dutcher | |
| 4,597,523 | A | 7/1986 | Schuster | |
| 4,621,766 | A | 11/1986 | McClure | |
| 4,773,533 | A | 9/1988 | Greene | |
| 4,919,269 | A * | 4/1990 | Wright et al. | B65D 5/48014 229/120.011 |
| 5,000,377 | A * | 3/1991 | McClure | B65D 5/007 229/150 |
| 5,072,876 | A | 12/1991 | Wilson | |
| 5,119,985 | A | 6/1992 | Dawson et al. | |
| 5,145,067 | A * | 9/1992 | Carver | B65D 71/16 206/426 |
| 5,295,623 | A | 3/1994 | Bacques | |
| 5,350,109 | A | 9/1994 | Brown et al. | |
| 5,360,104 | A | 11/1994 | Sutherland | |
| 5,390,848 | A | 2/1995 | Gungner et al. | |
| 5,588,585 | A | 12/1996 | McClure | |
| 5,669,500 | A * | 9/1997 | Sutherland | B65D 71/36 206/427 |
| 5,775,572 | A | 7/1998 | Oliff | |
| 6,021,898 | A * | 2/2000 | Sutherland | B65D 71/36 206/427 |
| 6,112,977 | A | 9/2000 | Sutherland et al. | |
| 6,170,741 | B1 | 1/2001 | Skolik et al. | |
| 6,250,542 | B1 | 6/2001 | Negelen | |
| 6,488,201 | B1 | 12/2002 | Van Eijndhoven et al. | |
| 6,595,411 | B2 | 7/2003 | McClure | |
| 6,631,803 | B2 | 10/2003 | Rhodes et al. | |
| 6,641,032 | B1 | 11/2003 | Schilling | |
| 6,766,940 | B2 | 7/2004 | Negelen | |
| 6,848,573 | B2 | 2/2005 | Gould et al. | |
| 6,968,992 | B2 | 11/2005 | Schuster | |
| 7,000,824 | B2 | 2/2006 | Saulas | |
| 7,290,696 | B2 | 11/2007 | McClure | |
| 7,743,970 | B2 | 6/2010 | Bates et al. | |
| 7,757,933 | B2 | 7/2010 | Dunn | |
| 7,775,418 | B2 | 8/2010 | Walling | |
| 7,780,067 | B2 | 8/2010 | Holley, Jr. | |
| 7,832,622 | B2 | 11/2010 | Spivey, Sr. | |
| 7,922,069 | B2 | 4/2011 | Gardner | |
| 7,984,843 | B2 | 7/2011 | Cooper et al. | |
| 7,998,047 | B2 | 8/2011 | Spivey, Sr. et al. | |
| 8,087,569 | B2 | 1/2012 | Ledvina | |
| 8,272,560 | B2 | 9/2012 | Quaintance | |
| 8,453,920 | B2 | 6/2013 | Schemmel et al. | |
| 8,875,885 | B2 | 11/2014 | Padden et al. | |
| 9,073,664 | B2 | 7/2015 | Justice | |
| 2002/0079245 | A1 * | 6/2002 | Auclair et al. | B65D 71/36 206/428 |
| 2005/0087592 | A1 | 4/2005 | Schuster | |
| 2005/0189405 | A1 | 9/2005 | Gomes et al. | |
| 2005/0263574 | A1 | 12/2005 | Schuster | |
| 2006/0081691 | A1 | 4/2006 | Smalley | |
| 2006/0278689 | A1 | 12/2006 | Boshinski et al. | |
| 2007/0051781 | A1 * | 3/2007 | Holley, Jr. | B65D 71/36 229/101 |
| 2007/0063003 | A1 | 3/2007 | Spivey et al. | |
| 2007/0108261 | A1 | 5/2007 | Schuster | |
| 2007/0131748 | A1 | 6/2007 | Brand | |
| 2007/0145105 | A1 | 6/2007 | Bates et al. | |
| 2008/0203143 | A1 | 8/2008 | Holley | |
| 2009/0032574 | A1 | 2/2009 | Casanovas et al. | |
| 2010/0025457 | A1 | 2/2010 | Cooper et al. | |
| 2011/0284622 | A1 * | 11/2011 | Boukredine | B65D 71/36 229/103.2 |
| 2011/0290692 | A1 | 12/2011 | Spivey, Sr. | |
| 2012/0279897 | A1 | 11/2012 | Schmal | |
| 2013/0292285 | A1 | 11/2013 | Kastanek | |
| 2014/0021082 | A1 | 1/2014 | Holley, Jr. | |

FOREIGN PATENT DOCUMENTS

| | | |
|---|---|---|
| JP | 2009-120248 | 6/2009 |
| KR | 20-2010-0010124 | 10/2010 |
| WO | WO 99/28198 | 6/1999 |

OTHER PUBLICATIONS

Supplementary European Search Report for EP 13 81 9280 dated Dec. 1, 2015.

Office Action for U.S. Appl., No. 13/833,542 dated May 6, 2015.

Response to Restriction Requirement for U.S. Appl. No. 13/833,542 dated Jun. 4, 2015.

Office Action for U.S. Appl. No. 13/833,542 dated Aug. 3, 2015.

Amendment A and Response to Office Action for U.S. Appl. No. 13/833,542 dated Oct. 29, 2015.

(56) References Cited

OTHER PUBLICATIONS

Office Action for U.S. Appl. No. 13/833,542 dated Feb. 16, 2016.
Request for Reconsideration for U.S. Appl. No. 13/833,542 dated Jun. 16, 2016.
Amendment B and Response to Final Office Action for U.S. Appl. No. 13/833,542 dated Jun. 16, 201.
Advisory Action for U.S. Appl. No. 13/833,542 dated Jun. 22, 2016.
Petition to the Director for U.S. Appl. No. 13/833,542 dated Jun. 23, 2016.
Decision on Petition under 37 CFR 1.181 for U.S. Appl. No. 13/833,542 dated Aug. 2, 2016.
Notice of Appeal for U.S. Appl. No. 13/833,542 dated Aug. 15, 2016.
Pre-Appeal Brief Request for Review for U.S. Appl. No. 13/833,542 dated Aug. 15, 2016.
Notice of Panel Decision from Pre-Appeal Brief Review for U.S. Appl. No. 13/833,542 dated Sep. 12, 2016.
Office Action for U.S. Appl. No. 13/833,542 dated Dec. 19, 2016.
Amendment C and Response to Office Action for U.S. Appl. No. 13/833,542 dated Mar. 13, 2017.
Office Action for U.S. Appl. No. 13/833,542 dated Mar. 30, 2017.
Request for Continued Examination (RCE) Transmittal for U.S. Appl. No. 13/833,542 dated Jun. 28, 2017.
Amendment D and Response to Final Office Action for U.S. Appl. No. 13/833,542 dated Jun. 28, 2017.
Office Action for U.S. Appl. No. 13/833,542 dated Sep. 19, 2017.
Amendment E and Response to Office Action for U.S. Appl. No. 13/833,542 dated Nov. 17, 2017.
Office Action for U.S. Appl. No. 13/833,542 dated Mar. 19, 2018.
Request for Continued Examination (RCE) Transmittal for U.S. Appl. No. 13/833,542 dated May 3, 2018.
Amendment F and Response to Final Office Action for U.S. Appl. No. 13/833,542 dated May 3, 2018.
Notice of Allowance and Fee(s) Due for U.S. Appl. No. 13/833,542 dated Nov. 13, 2018.
Issue Fee Transmittal Form for U.S. Appl. No. 13/833,542 dated Feb. 1, 2019.

* cited by examiner

METHOD OF FORMING A CARTON WITH ARTICLE PROTECTION FEATURE

CROSS-REFERENCE TO RELATED APPLICATIONS

This application is a division of U.S. patent application Ser. No. 13/833,542, filed Mar. 15, 2013, which claims the benefit of U.S. Provisional Patent Application No. 61/741,315, filed Jul. 17, 2012, U.S. Provisional Patent Application No. 61/741,314, filed Jul. 17, 2012, and U.S. Provisional Patent Application No. 61/797,758, filed Dec. 14, 2012.

INCORPORATION BY REFERENCE

The disclosures of U.S. patent application Ser. No. 13/833,542, which was filed on Mar. 15, 2013, U.S. Provisional Patent Application No. 61/741,315, which was filed on Jul. 17, 2012, U.S. Provisional Patent Application No. 61/741,314, which was filed on Jul. 17, 2012, U.S. Provisional Patent Application No. 61/797,758, which was filed on Dec. 14, 2012, U.S. patent application Ser. No. 13/419,740, filed Mar. 14, 2012, U.S. Provisional Application No. 61/518,504, filed May 6, 2011, U.S. Provisional Application No. 61/572,638, filed Jul. 19, 2011, U.S. Provisional Application No. 61/272,249, filed Oct. 7, 2011, U.S. Provisional Application No. 61/548,779, filed Oct. 19, 2011, and U.S. Provisional Application No. 61/570,044, filed Dec. 13, 2011, are hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons having an article protection feature and/or other features that protect the containers or articles from breakage.

SUMMARY OF THE DISCLOSURE

In general, one aspect of the disclosure is directed to a carton for holding a plurality of articles. The carton comprises a plurality of panels that extends at least partially around an interior of the carton and a plurality of end flaps respectively foldably connected to respective panels of the plurality of panels. The plurality of end flaps are at least partially overlapped with respect to one another to thereby at least partially form a closed end of the carton. The carton also can comprise at least one article protection flap foldably connected to at least one end flap of the plurality of end flaps for engaging at least one article of the plurality of articles. The at least one article protection flap extends from the closed end at least partially into the interior of the carton.

In another aspect, the disclosure is generally directed to a blank for forming a carton for holding a plurality of containers. The blank comprises a plurality of panels for extending at least partially around an interior of the carton formed from the blank and a plurality of end flaps respectively foldably connected to respective panels of the plurality of panels. The plurality of end flaps are for being at least partially overlapped with respect to one another to thereby at least partially form a closed end of the carton formed from the blank. The blank also can comprise at least one article protection flap foldably connected to at least one end flap of the plurality of end flaps for engaging at least one article of the plurality of articles. The at least one article protection flap is for being positioned to extend from the closed end of the carton formed by the blank at least partially into the interior of the carton formed by the blank.

In another aspect, the disclosure is generally directed to a method of forming a carton for holding a plurality of articles. The method comprises obtaining a blank comprising a plurality of panels, a plurality of end flaps respectively foldably connected to respective panels of the plurality of panels, and at least one article protection flap foldably connected to at least one end flap of the plurality of end flaps for engaging at least one article of the plurality of articles. The method also can comprise forming an interior of the carton at least partially defined by the plurality of panels. The forming the interior of the carton can comprise forming an open-ended sleeve. The method further can comprise at least partially closing an end of the carton by at least partially overlapping the plurality of end flaps with respect to one another, and positioning the at least one article protection flap to extend from the closed end at least partially into the interior of the carton.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "inner," "outer," "lower," "bottom," "upper," and "top" indicate orientations determined in relation to fully erected and upright cartons.

Figure 1:
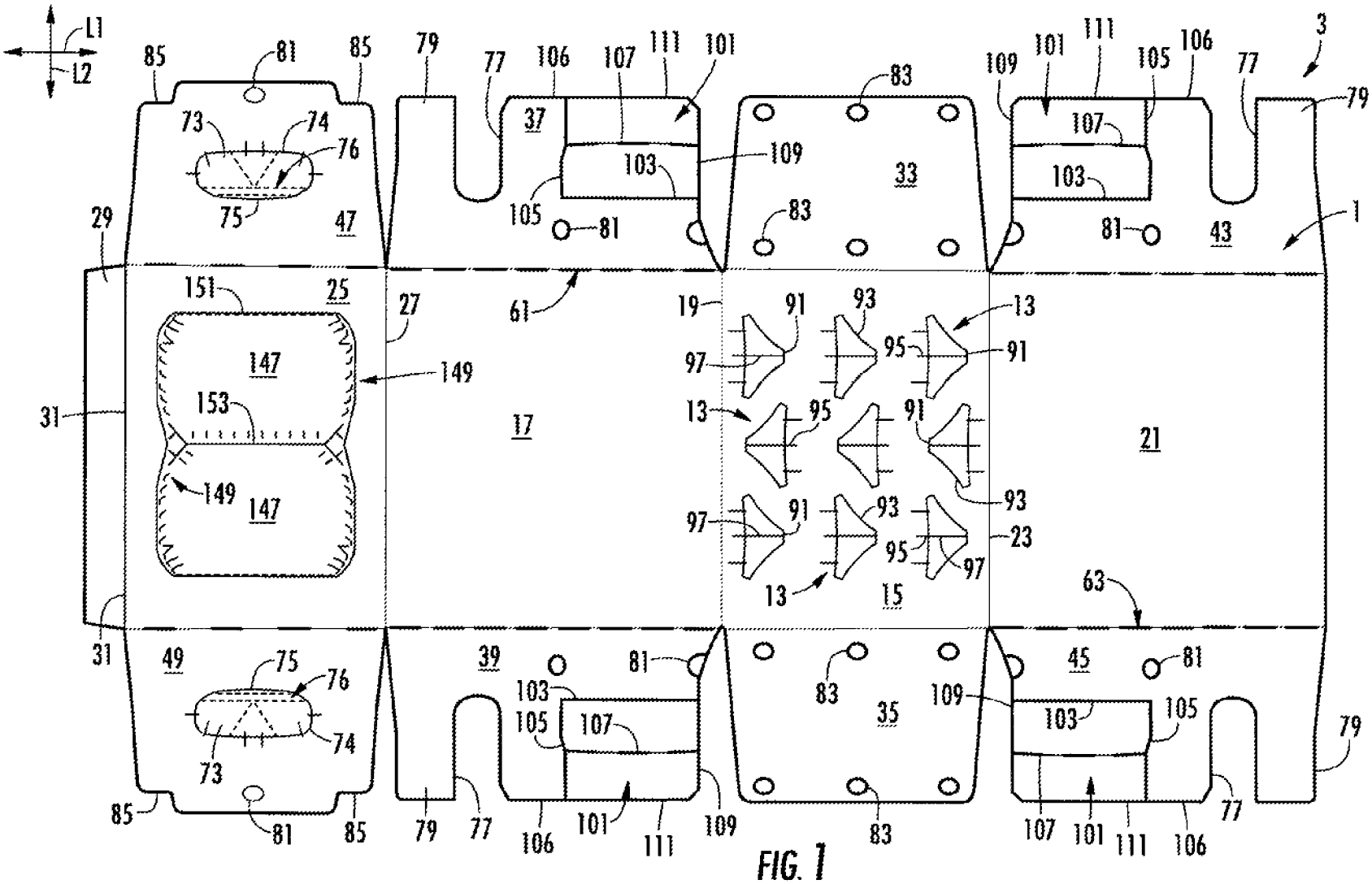
FIG. 1 is an exterior plan view of a blank used to form a carton according to an exemplary embodiment of the disclosure.
Figure 4:
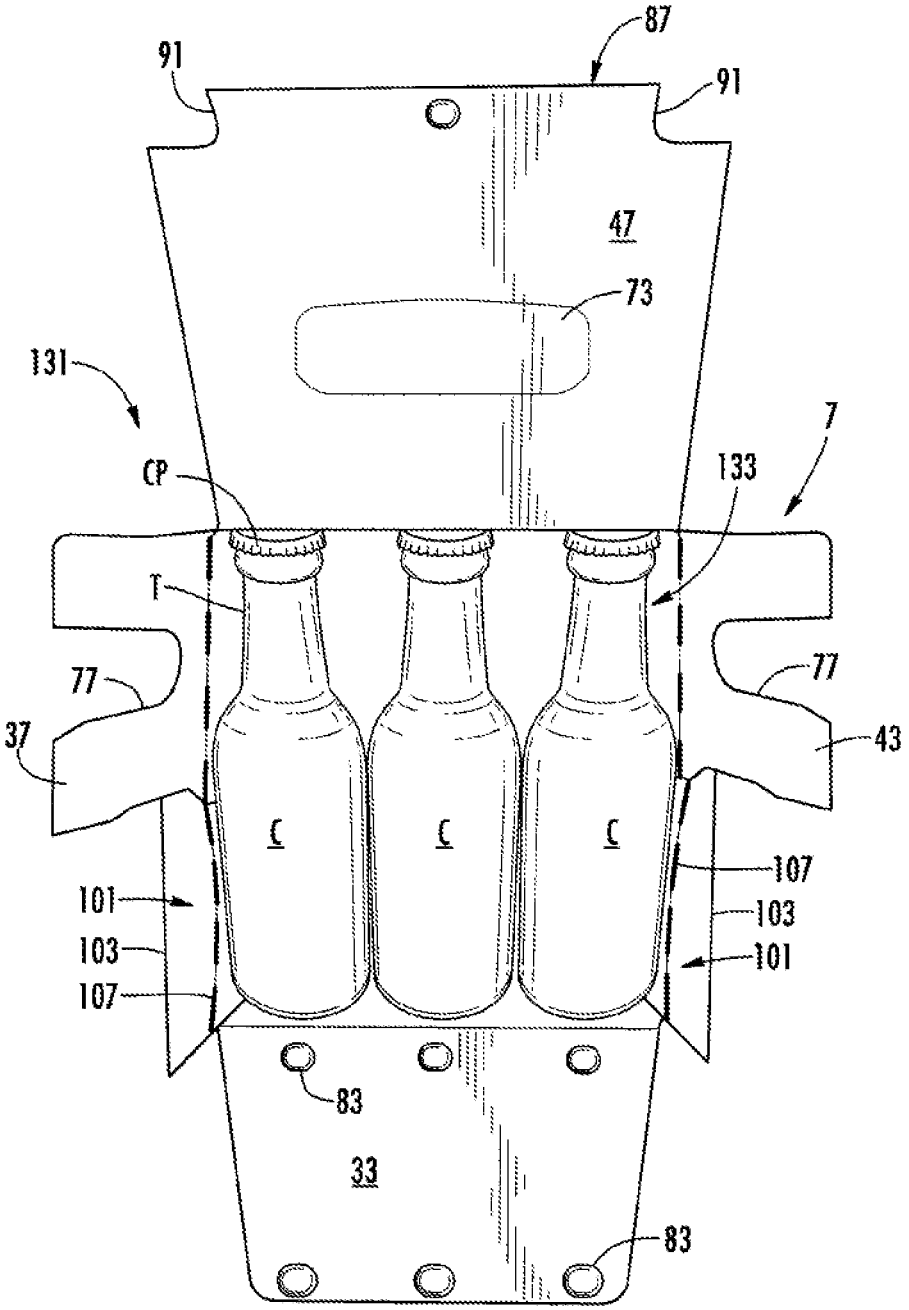
FIG. 4 is a perspective view of the open-ended sleeve of FIG. 3 with containers loaded therein.

FIG. 1 is a plan view of the exterior side 1 of a blank, generally indicated at 3, used to form a carton 5 (FIGS. 6 and 7) according to an exemplary embodiment of the disclosure. The carton 5 can be used to house a plurality of articles such as containers C (FIG. 4). In one embodiment, the containers are bottles having a wide bottom and a narrow top or neck T including a cap CP. In the illustrated embodiment, the carton 5 is sized to house twelve containers C in a single layer in a 3×4 arrangement, but it is understood that the carton 5 may be sized and shaped to hold containers of a different or same quantity in more than one layer and/or in different row/column arrangements (e.g., 1×6, 2×6, 4×6, 3×8, 2×6×2, 3×4×2, 2×9, 3×6, etc.), or just a single article. In the illustrated embodiment, the carton 5 includes a first end 7 and a second end 9, each with a respective handle, generally indicated at 10 (FIGS. 5-7) for grasping and carrying the carton at each of the ends 7, 9. The carton 5 could have only a single handle 10 in either of the ends 7, 9 without departing from the disclosure. As will be discussed below in more detail, the handles 10 are formed from various features in the carton blank 3.

In one embodiment, the first end 7 and the second end 9 of the carton 5 each have article protection features 11 (FIGS. 5 and 6) for protecting at least one article C of the plurality of articles. Additionally, the carton 5 of the first embodiment may have bottom article protection flaps 13 for protecting the at least one article. The article protection features 11 cushion the ends 7, 9 of the carton and prevent or reduce the likelihood of breakage of the containers C. In one embodiment, the bottom article protection flaps 13 are movable between a first position (FIG. 1) and a second position (FIG. 7) placed between adjacent containers C in the carton to reduce movement of the containers in the carton and prevent breakage of the containers. The article protection features and the bottom article protection flaps can be similar to, or the same as, those described in U.S. patent application Ser. No. 13/419,740, filed Mar. 14, 2012, the disclosure of which is hereby incorporated by reference for all purposes as if presented herein in its entirety. The article protection features 11 and/or the bottom article protection flaps 13 can be otherwise shaped, arranged, and/or configured without departing from the disclosure. Further, the article protection features 11 and/or bottom article protection flaps 13 can be omitted without departing from the disclosure.

The carton blank 3 has a longitudinal axis L1 and a lateral axis L2. In the embodiment of FIG. 1, the blank includes a bottom panel 15 foldably connected to a first side panel 17 at a lateral fold line 19. A second side panel 21 is foldably connected to the bottom panel 15 at a lateral fold line 23. A top panel 25 is foldably connected to the first side panel 17 at a lateral fold line 27, and an attachment flap 29 is foldably connected to the top panel 25 at a lateral fold line 31. Any of the top and bottom panels 25, 15, the first and second side panels 17, 21, and the attachment flap 29 can be otherwise shaped, arranged, configured, or omitted, without departing from the disclosure. For example, the blank 3 could include a second top panel foldably connected to the second side panel 21, or the attachment flap 29 could be foldably connected to the second side panel 21 instead of the top panel 25.

The bottom panel 15 is foldably connected to a first bottom end flap 33 and a second bottom end flap 35. The first side panel 17 is foldably connected to a first side end flap 37 and a second side end flap 39. The second side panel 21 is foldably connected to a first side end flap 43 and a second side end flap 45. The first top panel 25 is foldably connected to a first top end flap 47 and a second top end flap 49. In one embodiment, when the carton 5 is erected, the end flaps 33, 37, 43, 47 close the first end 7 of the carton, and the end flaps 35, 39, 45, 49 close the second end 9 of the carton. In accordance with an alternative embodiment of the present disclosure, different flap arrangements can be used for closing the ends 7, 9 of the carton 5.

The end flaps 33, 37, 43, 47 extend along a first marginal area of the blank 3, and are foldably connected at a first longitudinal fold line 61 that extends along the length of the blank. The end flaps 35, 39, 45, 49 extend along a second marginal area of the carton blank 3, and are foldably connected at a second longitudinal fold line 63 that also extends along the length of the blank. The longitudinal fold lines 61, 63 may be, for example, substantially straight, or offset at one or more locations to account for blank thickness or for other factors. The ends of the carton 5 could be otherwise shaped, arranged, and/or configured (e.g., at least partially tapered) without departing from the disclosure.

In the embodiment of FIG. 1, the carton blank 3 has handle features for forming the handles 10. The handle features can include handle flaps 73 foldably connected to a respective top end flap 47, 49 at an arcuate fold line 75 and separable from the respective top end flap 47, 49 along cut lines 74. In one embodiment, additional fold lines 76 can extend in each of the outer handle flaps 73. The handle flaps 73 could be omitted or could be otherwise shaped, arranged, and/or configured without departing from the disclosure.

The handle features can also include notches or openings 77 in the side end flaps 37, 39, 43, and 45. The openings 77 cooperate to provide an opening at a respective closed end 7, 9 to allow a respective handle flap 73 to be inwardly folded at a respective end. The side end flaps 37, 39, 43, 45 can also include respective upper portions 79 disposed above the respective openings 77. The blank 3 can have other features for forming the handles 10, or the blank 3 and/or carton 5 can have one or more handles that are alternatively shaped, arranged, and/or configured without departing from the disclosure. For example, either or both of the handle flaps 73 could be omitted. Further, one or both of the handles 10 can be omitted without departing from the disclosure.

In one embodiment, the carton blank 3 has features for forming the article protection features 11 of the carton 5. As shown in FIG. 1, the side end flaps 37, 39, 43, 45 and the top end flaps 47, 49 have deformations in the form of indentations 81 on the exterior surface of the carton blank 3 such that the indentations from a protrusion on the interior surface of the blank. The bottom end flaps 33, 35 each have two rows of deformations in the form of indentations 83 on the interior surface of the carton blank 3 such that the indentations on the interior surface form a protrusion on the exterior surface 1 of the carton blank 3. As shown in FIG. 1, the top end flaps 47, 49 each have corner notches 85. The indentations 81, 83 can be any deformation on a surface of a respective side end flaps 37, 39, 43, 45, top end flaps 47, 49, or bottom end flaps 33, 35 such that the deformation can be any suitable shape (e.g., a concave depression or protrusion, convex depression or protrusion, flat depression or protrusion, embossed area, debossed area, etc., or any other suitable shape). Furthermore, the indentations 81, 83 could be formed on the interior or exterior surface of one or more of the first side panel 17, second side panel 21, top panel 25, and/or bottom panel 15 without departing from the disclosure.

In the first embodiment, the carton blank 3 includes nine bottom article protection flaps 13 arranged in a 3×3 arrangement, but the blank could have more or less than nine bottom article protection flaps, and the flaps could be otherwise arranged in other suitable row/column arrangements or in a random configuration on the bottom panel 15, including a single row or single column configuration, or any other suitable configuration. In other embodiments, the carton blank 3 can include bottom article protection flaps that are different, similar, or identical to other bottom article protection flaps without departing from the disclosure. In the embodiment of FIG. 1, the middle row of bottom article protection flaps 13 are oriented 180 degrees relative to a row of bottom article protection flaps that are closer to the respective longitudinal fold lines 61, 63. In other embodiments, the bottom article protection flaps 13 could be otherwise shaped, arranged, and/or configured without departing from the disclosure.

As shown in FIG. 1, the bottom article protection flaps 13 are each foldably connected to the bottom panel 15 at a respective lateral fold line 91 and are each at least partially defined by a cut 93 in the bottom panel. Alternatively, the cut 93 could comprise other forms of weakening (e.g., a tear line that comprises cut lines separated by breakable nicks, a tear line that is formed by a series of spaced apart cuts, etc.) that allow the bottom article protection flap 13 to separated from the bottom panel 15 without departing from the disclosure. In one embodiment, a slit or cut 95 extends laterally from a portion of the cut 93 that is opposite to the lateral fold line 91. As shown in FIG. 1, the bottom article protection flap 13 can comprise generally longitudinal fold lines 97 extending from the lateral fold line 91. The fold lines 91, 97 and cuts 93, 95 could be otherwise shaped, arranged, configured, and/or omitted such that the article protection flap 13 has any other suitable shape or configuration without departing from the disclosure.

In the illustrated embodiment, a corner article protection flap or corner flap 101 can be foldably connected to each of the side end flaps 37, 39, 43, 45. The corner flaps 101 can help secure the containers C in the carton 5, help cushion the containers C, and/or help reinforce the respective corners 99 of the carton. Each of the corner flaps 101 can be foldably connected to the respective side end flap along a longitudinal fold line 103 and separable from the respective side end flap along a cut line 105, which can extend from an end of the longitudinal fold line 103 to a longitudinal free edge 106 of the respective side end flap. Each of the corner flaps 101 can include an intermediate fold line 107 extending from the cut line 105 to a lateral free edge 109 of the respective corner flap 101. In one embodiment, the intermediate fold line can be generally arcuate, as shown in FIG. 1. Accordingly, each of the corner flaps 101 can be folded and positioned generally proximate or adjacent a respective corner 99 of the carton 5 (FIG. 5) to at least partially conform to the shape of the containers C adjacent the corners and to help reduce the freedom of movement of the corner containers. The corner flaps 101 could be otherwise shaped, arranged, and/or configured without departing from the disclosure. Additionally, the carton can have a different number of corners 99 than corner flaps 101.

Figure 6:
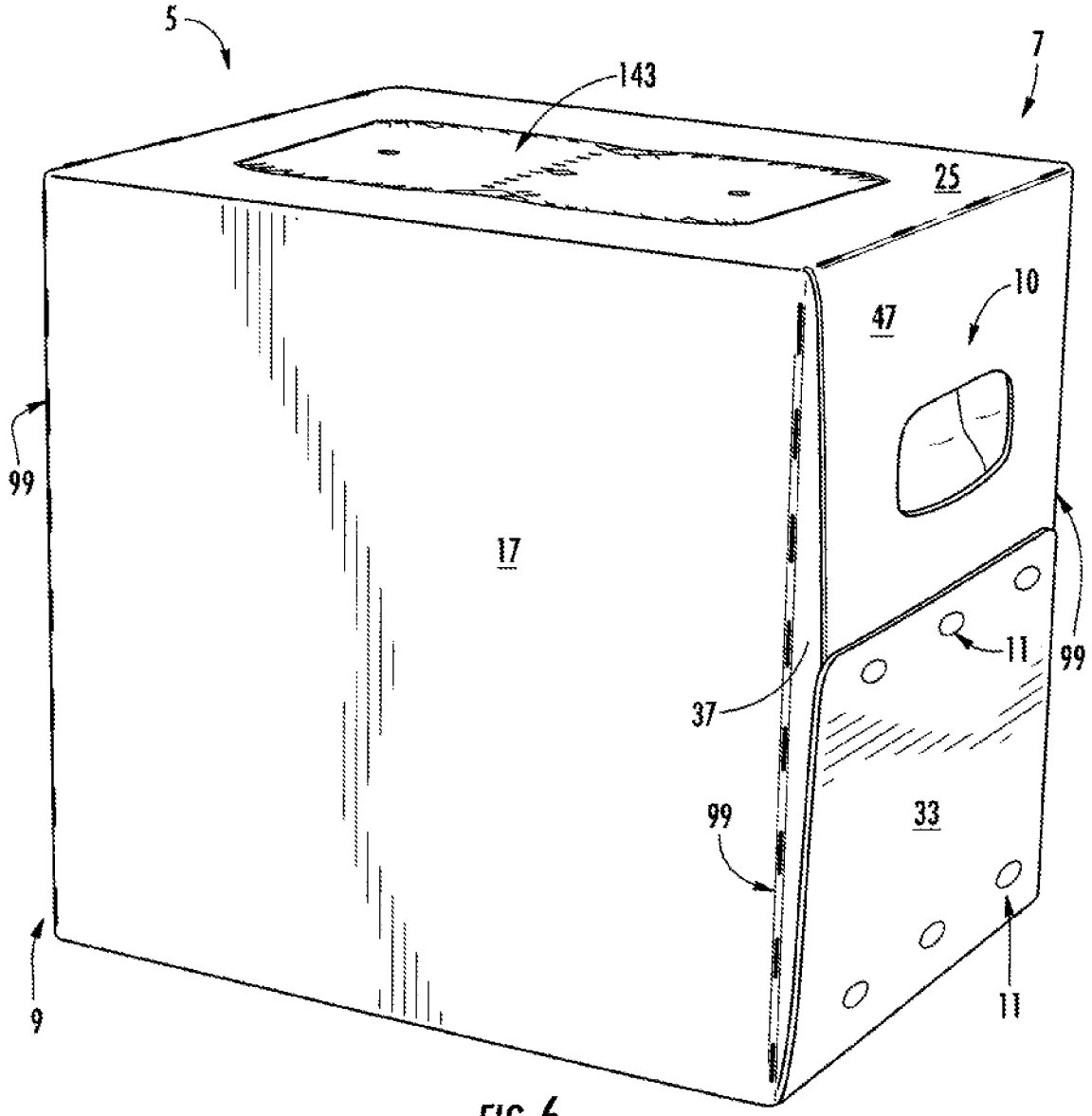
FIG. 6 is a perspective view showing the assembled carton according to the exemplary embodiment of the disclosure.

As shown in FIG. 1, the blank 3 includes dispenser features for forming a dispenser 143 in the carton 5 (FIG. 6). As shown in FIG. 1, the dispenser features include two dispenser panels 147 that are separable from the remainder of the first top panel 25 along tear lines 149 and are foldably connected to the first top panel 25 along a respective longitudinal fold line 151. The dispenser panels 147 are separable from one another along a longitudinal tear or cut line 153. The tear lines 149, fold lines 151, and/or cut line 153 could be otherwise shaped, arranged, and/or configured without departing from the disclosure.

Figure 2:
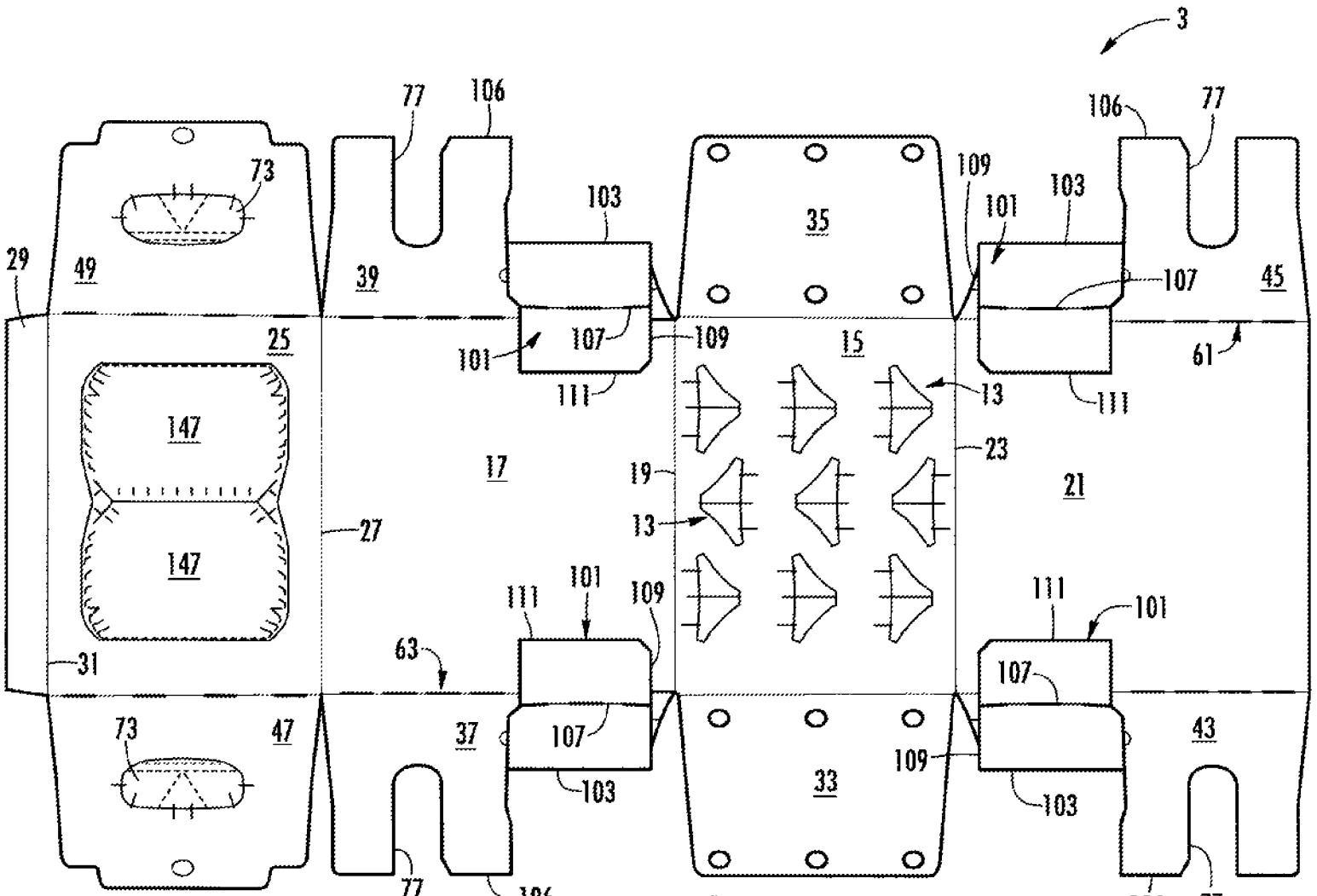
FIG. 2 is an interior view of a portion of the blank of FIG. 1 with inwardly folded corner flaps.

As shown in FIG. 2, the blank 3 can be prepared for forming the carton 5 by folding each of the corner flaps 101 in the respective side end flaps 37, 39, 43, 45 along the respective longitudinal fold lines 103 so that the corner flaps 101 overlap the respective side end flap and the respectively adjacent side panel 17, 21. In the illustrated embodiment, a respective longitudinal edge 111 of the corner flaps 101 can overlap and/or extend adjacent and/or contact a respectively adjacent side panel 17, 21. In one embodiment, at least the portion of each corner flap 101 between the longitudinal fold line 103 and the intermediate fold line 107 can be glued to the respective side end flap 37, 39, 43, 45. Alternatively, or in addition, the corner flaps 101 can be glued to the respective side panels 17, 21, or the glue could be omitted from the corner flaps so that they are free to pivot and/or slide relative to the side end flaps and/or the side panels.

Figure 3:
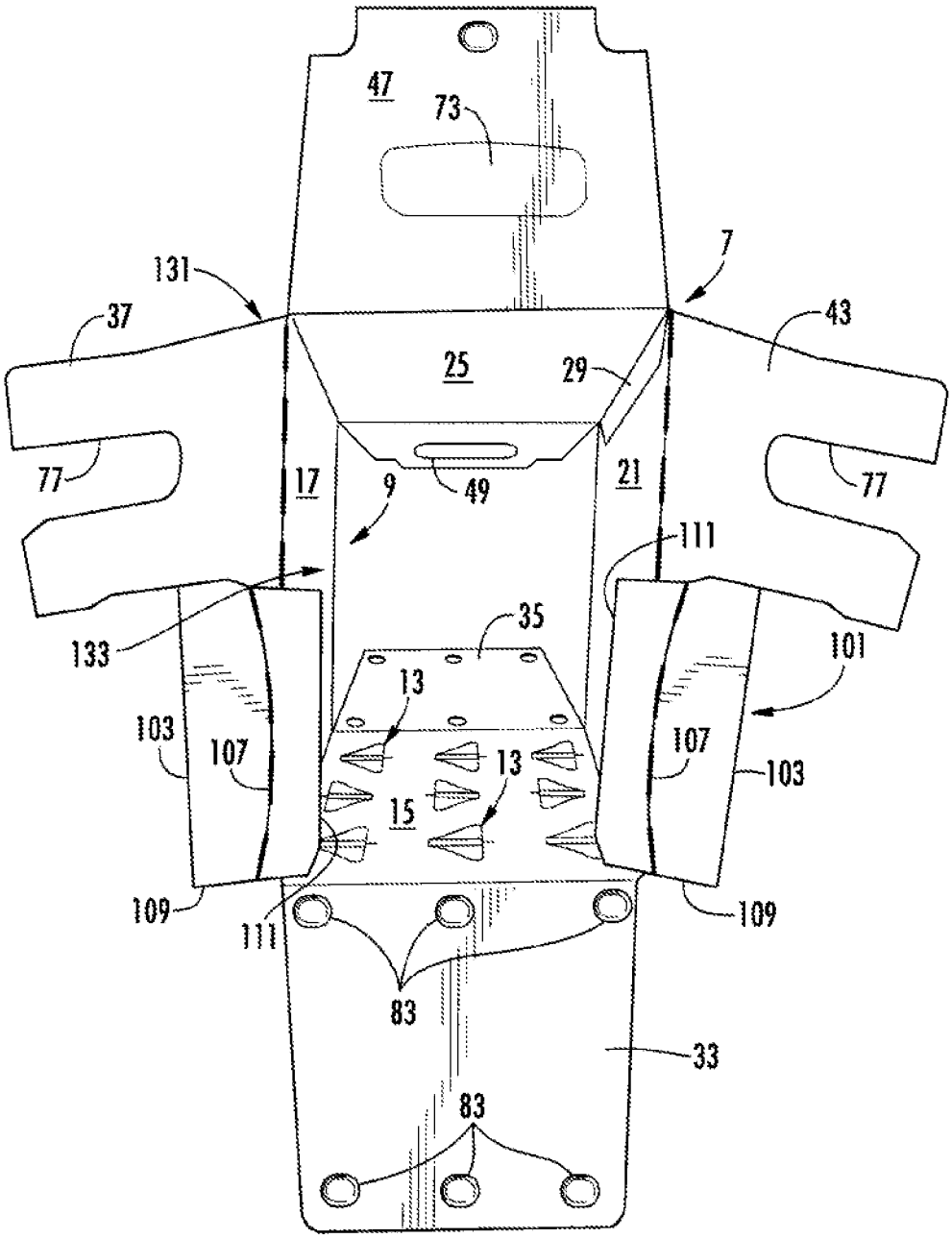
FIG. 3 is a perspective view of a partially-erected carton in the form of an open-ended sleeve according to the exemplary embodiment of the disclosure.

In one exemplary embodiment, the carton 5 can be assembled further by folding the blank 3 along the transverse fold lines 19, 23, 27, 31 to glue the attachment flap 29 in face-to-face contact with the inner surface of the second side panel 21, and to form an open-ended sleeve 131 with an interior 133 (FIG. 3). As shown in FIG. 4, the containers C can be loaded into the interior 133 of the open-ended sleeve 131 before or after closing either of the ends 7, 9. In the illustrated embodiment, when the containers C adjacent the first end 7 are loaded into the interior 133, the side end flaps 37, 43 can be partially closed so that the longitudinal edges 111 of the corner flaps 101 are positioned between the containers C in the corners of the carton and the respective side panels 17, 21. In one embodiment, the edges 111 and the portions of the corner flaps 101 adjacent the edges 111 can be in contact the respective corner containers C and/or the respective side panels 17, 21, and can be generally sandwiched between a container and a side panel. The corner flaps 101 at the second end 9 can be similarly disposed between respective containers C and side panels 17, 21. The blank 3 may be otherwise formed into the open-ended sleeve using alternative folding and gluing steps without departing from the scope of this disclosure. Additionally, the containers C could be otherwise loaded into the interior 133 of the open-ended sleeve 131 without departing from the scope of this disclosure.

In the illustrated embodiment, the side end flaps 37, 43 are inwardly folded along the longitudinal fold line 61 to at least partially close the first end 7. As the side end flaps 37, 43 are folded, the corner flaps 101 slide against the respective side panels 17, 21 and bend along the respective intermediate fold lines 107 to bend around the corners 99 of the carton 5 and the containers C adjacent the corners. Additionally, the corner flaps 101 can bend to generally conform to the curve of the respectively adjacent containers. The top end flap 47 is folded along the longitudinal fold line 61 so that the top end flap 47 overlaps the side end flaps 37, 43 and the handle flap 73 is generally aligned with the openings 77. In one embodiment, the top end flap 47 can be glued in face-to-face contact with the side end flaps 37, 43. The bottom end flap 33 is folded upwardly along the longitudinal fold line 61 into face-to-face contact with the lower portions of the side end flaps 37, 43. In one embodiment, the bottom end flap 33 overlaps a portion of the outer top end flap 47 (FIG. 6). The bottom end flap 33 can be glued to the side end flaps 37, 43 and/or the top end flap 47. Accordingly, the handle 10 (FIGS. 5 and 6) in the first end 7 is formed by the alignment of the handle flap 73 of the top end flap 47 and the openings 77 of the side end flaps 37, 43. The top end flap 47, the side end flaps 37, 43, and the bottom end flap 33 can be selectively adhered to one another to close the first end 7 of the carton 5 (FIGS. 5 and 6).

In one embodiment, the second end 9 of the carton 5 can be closed in a similar manner as the first end 7 by folding, respectively overlapping, and selectively adhering the side end flaps 39, 45, the top end flaps 49, 53, and the bottom end flap 35. The erected carton is shown in FIG. 6. As shown in FIGS. 5 and 6, when the side end flaps 37, 43, 39, 45 are folded over the respective ends 7, 9, the portions of the longitudinal fold lines 61, 63 connecting the side end flaps 37, 43, 39, 45 to the respective side panels 17, 21 form and/or extend along a respective corner 99 of the carton. One or both of the ends 7, 9 could be otherwise shaped, arranged, configured, or omitted, without departing from the disclosure. Additionally, the open-ended sleeve 131 can be alternatively loaded with containers and closed without departing from the disclosure. For example, the ends 7, 9 can be closed in any order, and the containers could be loaded before or after closing either or both of the ends 7, 9. Additionally, the corner flaps 101 could be folded along longitudinal fold lines 103 and/or glued before or after any step of forming the carton 5.

Figure 5:
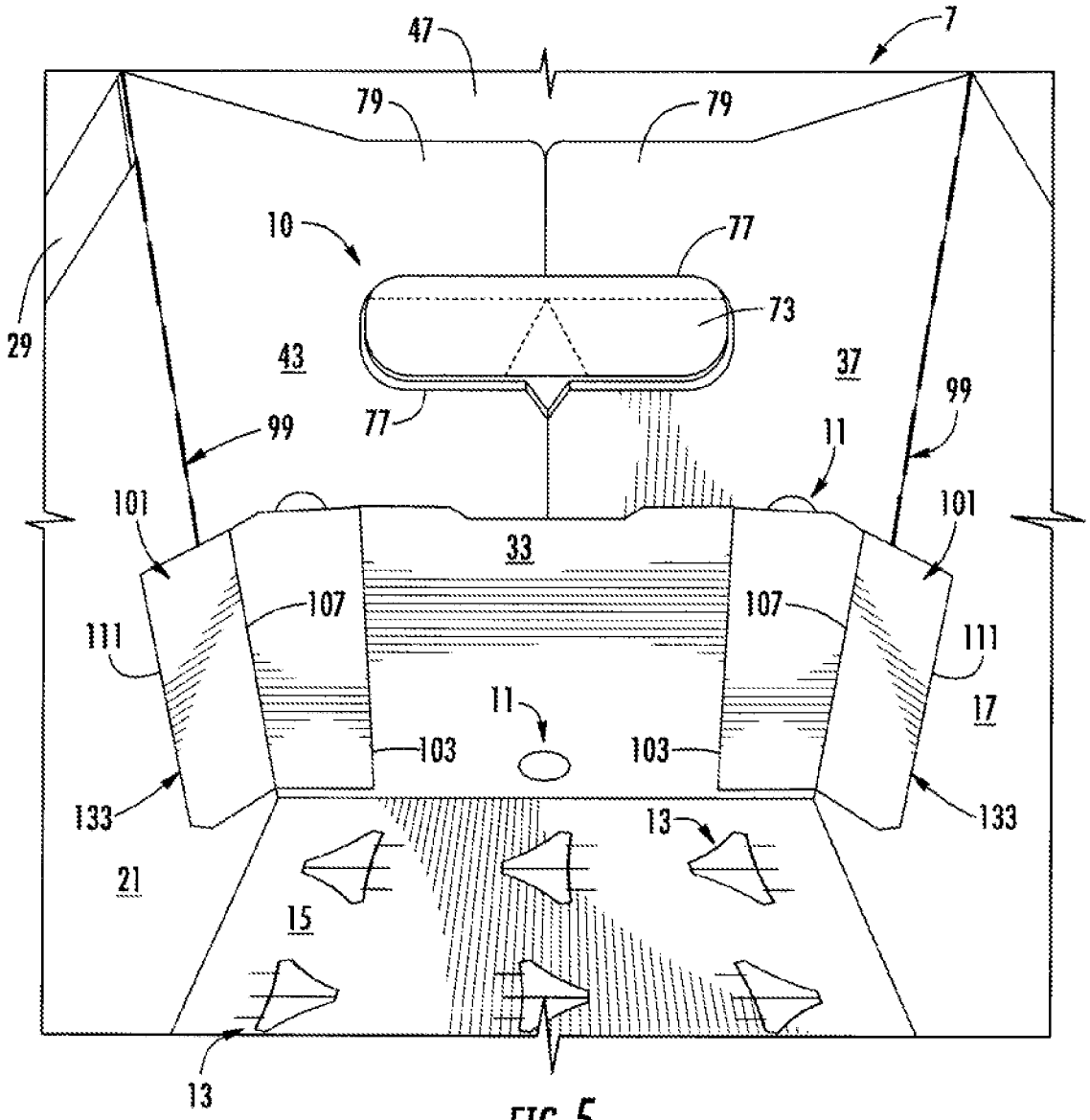
FIG. 5 is an interior perspective view of a closed end of the erected carton according to the exemplary embodiment of the disclosure.

In the exemplary embodiment, FIG. 5 shows the first end 7 of the carton 5 from the interior 133 of the carton with the containers C omitted for clarity. As shown in FIG. 5, the corner flaps 101 extend in the corners 99 of the carton 5 with the longitudinal edges 111 of the corner flaps extending adjacent and/or in contact with the respective side panels 17, 21. The corner flaps 101 can help protect the articles in the carton by cushioning the containers C and/or reducing the space in the interior 133 of the carton for the containers C to move. Accordingly, the corner flaps 101 can push the containers C adjacent the corners 99 of the carton against the other containers C in the carton and reduce the freedom of movement of the containers. In one embodiment, the carton can have a different number of corners 99 than corner flaps 101. For example, two of the corner flaps 101 could be omitted so only two corner flaps 101 are disposed in opposing corners 99 of the carton. The corner flaps 101 and/or the corners 99 could be otherwise shaped, arranged, and/or configured without departing from the disclosure.

Figure 7:
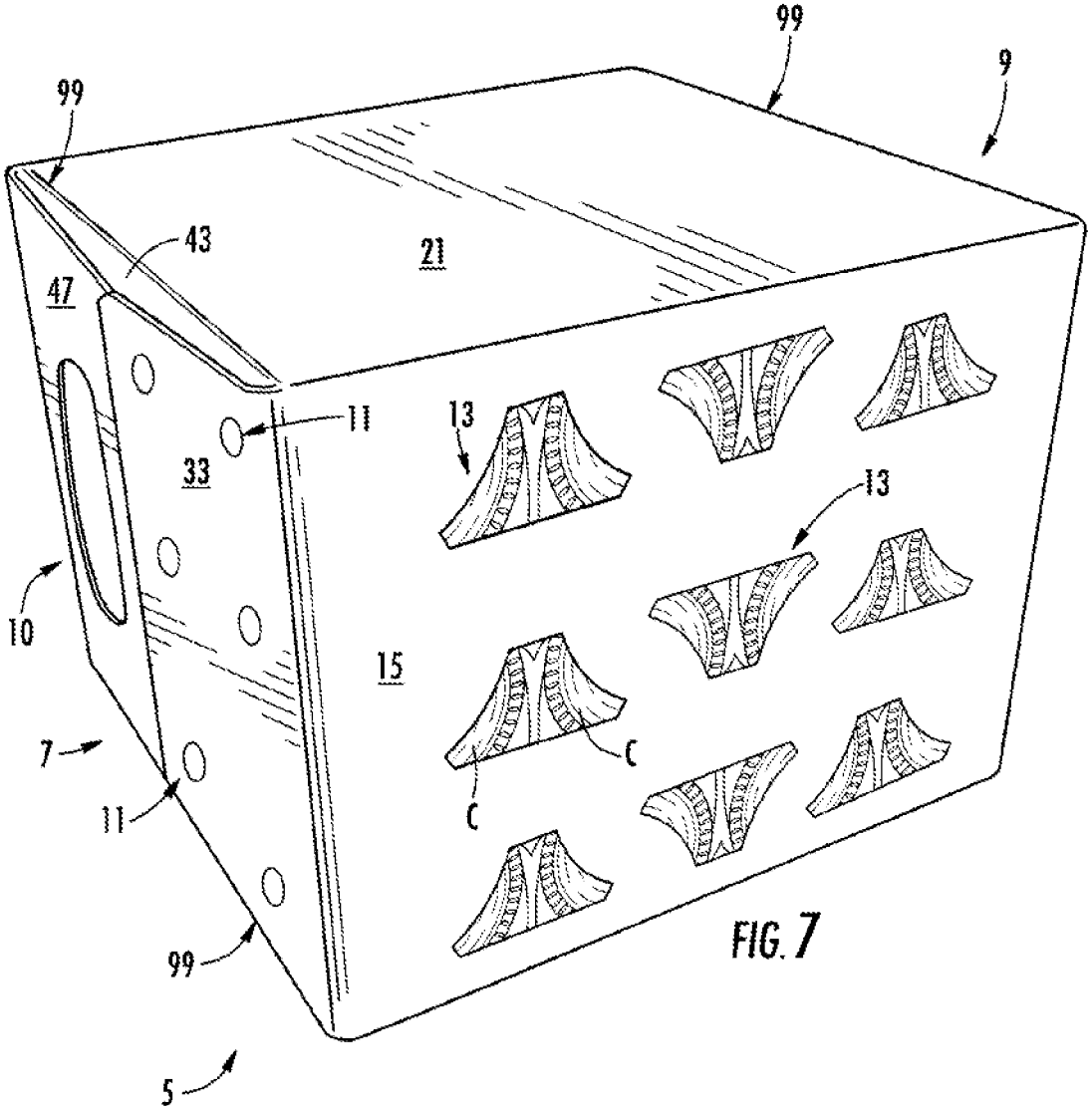
FIG. 7 is a bottom perspective view of the assembled carton of FIG. 6.

In the illustrated embodiment, the corner flaps 101 cooperate with the bottom article protection flaps 13 and the article protection features 11 to help reduce breaking of the containers C. For example, the article protection features 11 can provide additional cushioning for the containers C at the ends 7, 9 of the carton. The bottom article protection flaps 13 can be pushed into the interior 133 of the carton 5 from the bottom panel 15 as shown in FIG. 7. Accordingly, each of the bottom article protection flaps 13 can be pushed up between two respective containers C to further reduce the freedom of movement of the containers C.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A method of forming a carton for holding a plurality of articles, the method comprising:

obtaining a blank comprising a plurality of panels, a plurality of end flaps respectively foldably connected to respective panels of the plurality of panels, and a corner flap for engaging at least one article of the plurality of articles, the plurality of panels comprising at least a top panel, a side panel foldably connected to the top panel, and a bottom panel foldably connected to the side panel, the plurality of end flaps comprising at least a side end flap foldably connected to the side panel, the corner flap being foldably connected to the side end flap;

forming an interior of the carton at least partially defined by the plurality of panels, the forming the interior of the carton comprising forming an open-ended sleeve;

at least partially closing an end of the carton by at least partially overlapping the plurality of end flaps with respect to one another; and positioning the corner flap to extend from the closed end at least partially into the interior of the carton and in contact with the side panel, the corner flap is spaced apart from the top panel.

2. The method of claim 1, wherein the side end flap is foldably connected to the side panel along a first fold line, the corner flap is foldably connected to the side end flap along a second fold line, and the corner flap extends from the second fold line to a free edge of the corner flap.

3. The method of claim 2, wherein at least a portion of the side end flap extends from the first fold line to the second fold line.

4. The method of claim 2, wherein the positioning the corner flap comprises positioning at least a portion of the free edge of the corner flap in contact with the side panel.

5. The method of claim 2, wherein at least a portion of the first fold line extends along at least a portion of a respective corner of the carton and the positioning the corner flap comprises positioning the corner flap to extend adjacent the respective corner of the carton.

6. The method of claim 5, wherein the corner flap comprises a third fold line extending at least partially across the corner flap, the positioning the corner flap comprises positioning the third fold line proximate the respective corner.

7. The method of claim 6, wherein the third fold line extends from a first edge of the corner flap to an opposing second edge of the corner flap.

8. The method of claim 2, wherein the second fold line is generally parallel to the first fold line, and the positioning the corner flap comprises folding the corner flap along the second fold line so that at least a portion of the corner flap is disposed proximate the first fold line.

9. The method of claim 8, wherein the blank further comprises at least one bottom article protection flap foldably connected to the bottom panel, and the method further comprises positioning the at least one bottom article protection flap to extend at least partially into the interior of the carton for engaging the at least one article.

10. The method of claim 2, wherein the free edge of the corner flap extends in a direction from the bottom panel toward the top panel.

11. The method of claim 1, wherein the blank further comprises handle features in at least the plurality of end flaps, and the at least partially overlapping the plurality of end flaps comprises forming at least one handle in the closed end, the at least one handle being spaced apart from the corner flap.

12. The method of claim 11, wherein the handle is spaced apart from the top panel.

13. The method of claim 12, wherein the handle is disposed between the corner flap and the top panel.

14. The method of claim 1, wherein the corner flap is at least partially defined by a cut line extending in the side end flap.

15. The method of claim 14, wherein the positioning the corner flap comprises at least partially separating the corner flap from the side end flap along the cut line and independently positioning the corner flap relative to the side end flap.

16. The method of claim 1, further comprising obtaining a plurality of articles and loading the plurality of articles into the interior of the carton.

17. The method of claim 16, wherein the positioning the corner flap comprises placing the corner flap in contact with at least one article of the plurality of articles.

18. The method of claim 17, wherein the positioning the corner flap comprises bending the corner flap to conform to a shape of the at least one article.

19. The method of claim 17, wherein the positioning the corner flap comprises pushing the at least one article against other articles of the plurality of articles.

* * * * *